United States Patent [19]

Bidegaray

[11] Patent Number: 4,512,426

[45] Date of Patent: Apr. 23, 1985

[54] ROTATING BITS INCLUDING A PLURALITY OF TYPES OF PREFERENTIAL CUTTING ELEMENTS

[75] Inventor: Dominique A. Bidegaray, Paris, France

[73] Assignee: Christensen, Inc., Salt Lake City, Utah

[21] Appl. No.: 483,896

[22] Filed: Apr. 11, 1983

[51] Int. Cl.[3] ..... E21B 10/46

[52] U.S. Cl. ..... 175/329; 175/410; 408/224; 407/62

[58] Field of Search ..... 175/329, 330, 379, 410; 408/224, 223, 206; 407/7, 62

[56] References Cited

U.S. PATENT DOCUMENTS

| | | | |
|---|---|---|---|
| 2,121,202 | 6/1938 | Killgore | 175/410 |
| 2,495,400 | 1/1950 | Williams, Jr. | 175/330 |
| 2,955,810 | 10/1960 | McWharter | 175/410 |
| 4,116,289 | 9/1978 | Feenstra | 175/321 |
| 4,343,371 | 8/1982 | Baker et al. | 175/376 |

FOREIGN PATENT DOCUMENTS

| | | | |
|---|---|---|---|
| 2095724 | 10/1982 | United Kingdom | 175/329 |

*Primary Examiner*—Stephen J. Novosad
*Assistant Examiner*—Mark J. DelSignore
*Attorney, Agent, or Firm*—Beehler, Pavitt, Siegemund, Jagger & Martella

[57] ABSTRACT

A rotating bit, particularly a rotary bit, is provided with a plurality of teeth incorporating diamond cutting elements of a first and second type. Each type of tooth is particularly adapted to cut a particular type of rock formation. For example, the plurality of the first type of teeth are particularly designed to cut soft to medium-hard rock formations, and the plurality of the second type of teeth are particularly adapted to cut hard or abrasive rock formations. In one embodiment, the first type of teeth are set on the bit face to have a greater exposure from the bit face than the second type of teeth. In that case, the first type of teeth will engage the rock formation first. A second embodiment has the relative disposition of the first and second types of teeth as measured by their disposition from the axis of rotation on the bit reversed. In the case where the teeth, which are adapted for hard rock cutting, extend furthermost from the bit, the rock formation first comes into contact with these teeth and if it should be a hard rock formation, primary cutting action will be accomplished with the hard rock cutting teeth, while the soft rock cutting teeth are held out of contact from the formation to minimize wear of these softer rock cutting teeth. However, when a soft rock formation is encountered, the hard rock teeth will fully embed into the softer rock formation, thereby allowing full engagement of the softer rock formation cutting teeth.

23 Claims, 14 Drawing Figures

FIG. 5
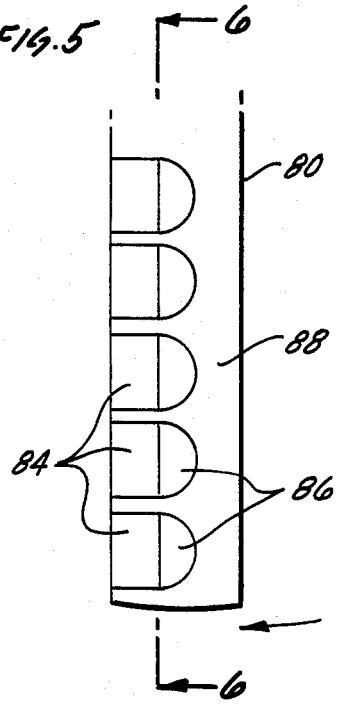
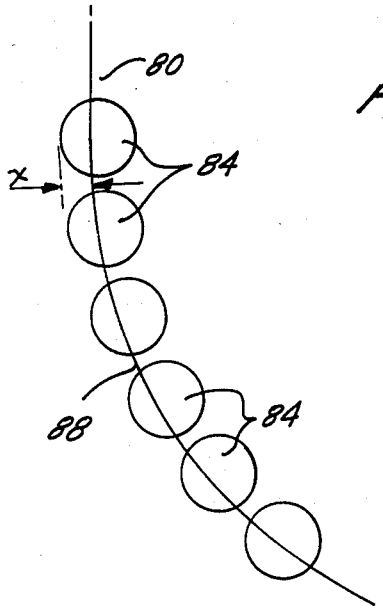
FIG. 6
FIG. 7
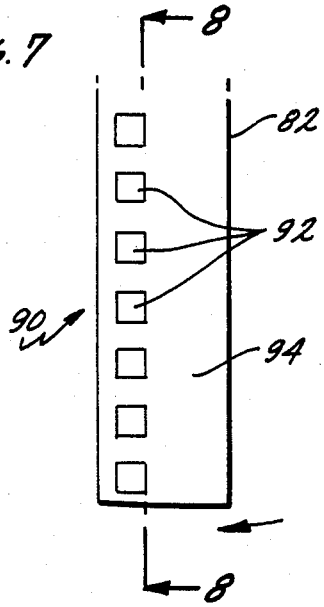
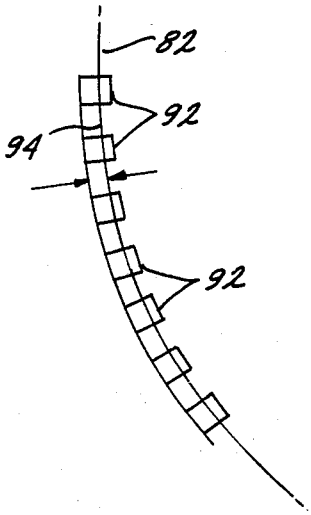
FIG. 8

FIG. 9
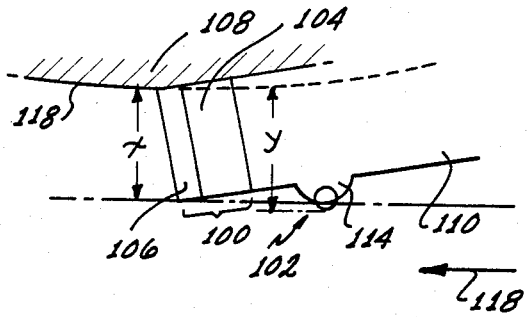
FIG. 11
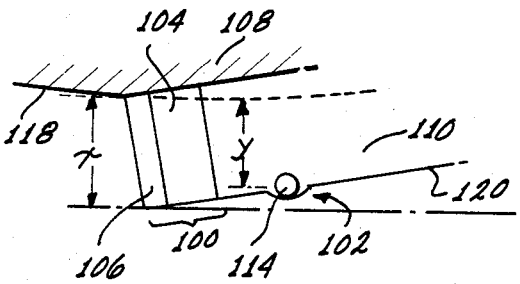
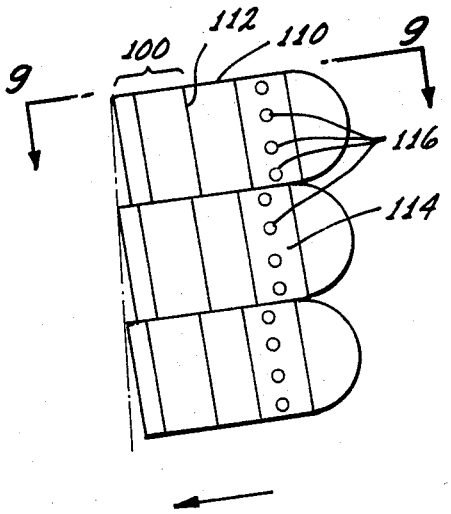
FIG. 10
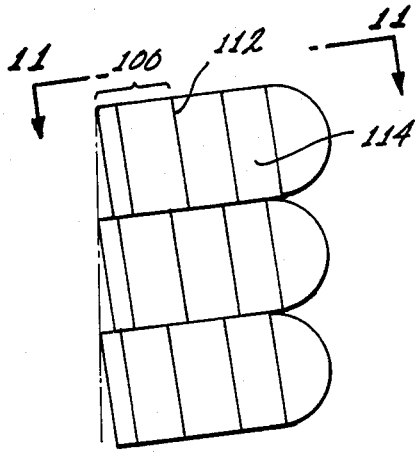
FIG. 12

ROTATING BITS INCLUDING A PLURALITY OF TYPES OF PREFERENTIAL CUTTING ELEMENTS

BACKGROUND OF THE INVENTION

1. Field of the Invention

The present invention relates to the field of earth boring bits and more particularly to rotating bits incorporating diamond cutting elements.

2. Description of the Prior Art

The use of diamonds in drilling products is well known. More recently synthetic diamonds both single crystal diamonds (SCD) and polycrystalline diamonds (PCD) have become commercially available from various sources and have been used in such products, with recognized advantages. For example, natural diamond bits effect drilling with a plowing action in comparison to crushing in the case of a roller cone bit, whereas synthetic diamonds tend to cut by a shearing action. In the case of rock formations, for example, it is believed that less energy is required to fail the rock in shear than in compression.

More recently, a variety of synthetic diamond products has become available commercially some of which are available as polycrystalline products. Crystalline diamonds preferentially fractures on (111), (110) and (100) planes whereas PCD tends to be isotropic and exhibits this same cleavage but on a microscale and therefore resists catastrophic large scale cleavage failure. The result is a retained sharpness which appears to resist polishing and aids in cutting. Such products are described, for example, in U.S. Pat. Nos. 3,913,280; 3,745,623; 3,816,085; 4,104,344 and 4,224,380.

In general, the PCD products are fabricated from synthetic and/or appropriately sized natural diamond crystals under heat and pressure and in the presence of a solvent/catalyst to form the polycrystalline structure. In one form of product, the polycrystalline structures includes sintering aid material distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being achieved by dissolving out the nondiamond material or at least a portion thereof, as disclosed for example, in U.S. Pat. Nos. 3,745,623; 4,104,344 and 4,224,380. For convenience, such a material may be described as a porous PCD, as referenced in U.S. Pat. No. 4,224,380.

Polycrystalline diamonds have been used in drilling products either as individual compact elements or as relatively thin PCD tables supported on a cemented tungsten carbide (WC) support backings. In one form, the PCD compact is supported on a cylindrical slug about 13.3 mm in diameter and about 3 mm long, with a PCD table of about 0.5 to 0.6 mm in cross section on the face of the cutter. In another version, a stud cutter, the PCD table also is supported by a cylindrical substrate of tungsten carbide of about 3 mm by 13.3 mm in diameter by 26 mm in overall length. These cylindrical PCD table faced cutters have been used in drilling products intended to be used in soft to medium-hard formations.

Individual PCD elements of various geometrical shapes have been used as substitutes for natural diamonds in certain applications on drilling products. However, certain problems arose with PCD elements used as individual pieces of a given carat size or weight. In general, natural diamond, available in a wide variety of shapes and grades, was placed in predefined locations in a mold, and production of the tool was completed by various conventional techniques. The result is the formation of a metal carbide matrix which holds the diamond in place, this matrix sometimes being referred to as a crown, the latter attached to a steel blank by a metallurgical and mechanical bond formed during the process of forming the metal matrix. Natural diamond is sufficiently thermally stable to withstand the heating process in metal matrix formation.

In this procedure above described, the natural diamond could be either surface-set in a predetermined orientation, or impregnated, i.e., diamond is distributed throughout the matix in grit or fine particle form.

Because of the difficulty of securely setting and retaining polycrystalline diamond elements on the face of a rotating bit, all prior art designs have assumed a fixed tooth design which is then distributed across the bit face to maximize cutting efficiency given the bit profile and tooth design chosen. Therefore, a limitation on the performance of the rotating bit has been those limitations which are inherent to the tooth design in the diamond cutting element included within the tooth, which were chosen. The prior art approach has been to manipulate all other design variables to maximize cutting efficiency with the given tooth. This has meant that if the tooth design is characterized by a large bite, which is inherently adapted to cutting soft to medium-hard rock formations and since the teeth by their nature are immobile and fixed on the bit face, the best that can be expected is that the overall bit design will be maximized to cut soft and medium-hard rock formations. Similarly, when the tooth design and diamond element within the tooth were particularly adapted to cutting hard or abrasive rock formations, the best that could be hoped for was to provide a tooth configuration and bit profile which would maximize overall bit design for cutting in hard and abrasive rock formations.

Therefore, what is needed is a design wherein fixed and immobile diamond cutting elements on a rotating bit can be exploited so that the bit is adaptable for cutting all types of rock formations and is not limited by the inherent cutting efficiencies of the type of tooth design used on the bit.

BRIEF SUMMARY OF THE INVENTION

The present invention is an improvement in a rotating bit having a bit face comprising a first plurality of cutting teeth of a first type which are disposed on the bit face. The cutting teeth of this first type are characterized by a preferential cutting performance with respect to a first type of material. More specifically, cutting teeth of the first type are arranged and configured to preferentially cut soft to medium-hard rock formations. A second plurality of teeth are also disposed on the bit face and are characterized by a preferential cutting performance with respect to a second type of material, namely hard or abrasive material. The first plurality of teeth are arranged and configured on the bit face to primarily cut the first type of material, the soft material, and to secondarily cut the second type of material, the harder material. Similarly, the second plurality of teeth of the second type are arranged and configured on the bit face to primarily cut the second type of material, the harder abrasive material, and to secondarily cut the first type of material, namely, the soft material. By reason of this combination of elements, the cutting performance of the rotating bit provided with this first and second plurality of teeth is primarily attributable to the first or second plurality of teeth depending on whether the rotating bit is cutting into a first or second type of material respectively. In other words, a bit designed according to the present invention automatically and by virtue of its design, appropriately brings to bear a type of tooth particularly adapted for efficient cutting of either softer or harder material.

The present invention and its various embodiments may be better understood by considering the following drawings wherein like elements are referenced by like numerals.

BRIEF DESCRIPTION OF THE DRAWINGS

FIG. 5 is a diagrammatic plan view of a plurality of teeth of the first type having a preferential cutting performance with respect to a first type of material as shown in a second embodiment of the present invention.

FIG. 6 is a diagrammatic sectional view taken through line 6—6 of FIG. 5.

FIG. 7 is a diagrammatic plan view of a plurality of teeth of a second type with a preferential cutting performace for a corresponding second type of material shown in the second embodiment of the present invention.

FIG. 8 is a sectional view taken through line 8—8 of FIG. 7.

FIG. 9 is a diagrammatic sectional view taken through line 9—9 of FIG. 10 of a third embodiment of the present invention wherein a tooth of both the first and second type are illustrated in the same Figure.

FIG. 10 is a diagrammatic plan view of the third embodiment as shown in FIG. 9.

FIG. 11 is a diagrammatic sectional view taken through line 11—11 of FIG. 12 showing a fourth embodiment of the present invention, wherein a tooth element of both the first and second type are illustrated in the same Figure.

FIG. 12 is a diagrammatic plan view of the fourth embodiment as illustrated in FIG. 11.

Figure 1:
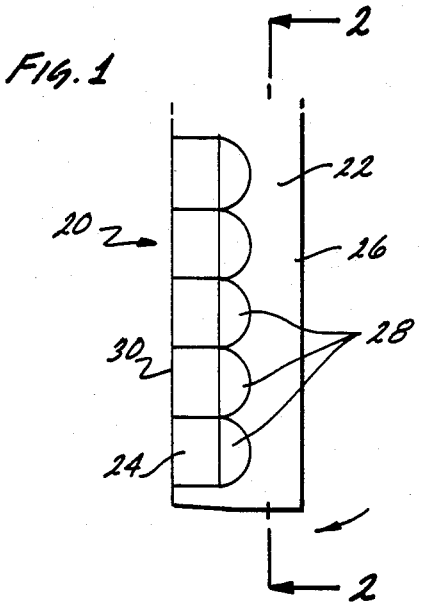
FIG. 1 is a diagrammatic plan view of a plurality of teeth of a first type with a corresponding first preferential cutting performance.

The present invention and its various embodiments are better understood by considering the above figures in light of the following detailed description.

DETAILED DESCRIPTION OF THE PREFERRED EMBODIMENTS

The present invention is a diamond rotating bit incorporating two types of teeth. One type of tooth is particularly adapted both in tooth design and diamond composition for cutting medium to softer rock formations whereas the other type of tooth, again both by tooth design and diamond composition, is particularly adapted to cutting hard rock formations. The two types of teeth are disposed in or on a rotating bit on a single pad, alternating adjacent pads or other tooth configurations on the rotating bit so that the distance by which such teeth extend above the face of the rotating bit is different. In order words, in one embodiment, the hard rock formation cutting teeth may extend by the greater distance from the bit face so that when the hard formation cutting teeth are in contact with the rock formation, they hold the remaining portions of the bit face, namely those portions including the soft rock formation cutting teeth away from contact or full engagement with the rock formation. In this way, the primary cutting action is performed by the hard rock cutting teeth. When a stratification of softer rock is encountered by the rotating bit, the hard formation cutting teeth fully embed within the softer rock formation thereby allowing full contact of the softer rock formation cutting elements with the rock formation. Because of the design of the tooth and composition material, the softer rock cutting teeth will then provide the primary cutting action of the rotating bit.

In another embodiment of the present invention, the teeth particularly designed and adapted to cut softer rock formations may be disposed above the bit face by a distance greater than the teeth particularly adapted for cutting hard rock formations. In that case, when cutting through soft formations, the soft rock cutting teeth provide the primary cutting action and the hard rock cutting teeth may be held out of contact or engagement with the soft rock formation. However, when a stratified layer of hard rock is encountered by the rotating bit, the softer cutting teeth will be preferentially worn away until the harder rock cutting teeth are fully engaged with the harder rock formation thereby limiting the wear of the softer cutting teeth and thus providing the primary cutting action in the hard rock formation.

These and other embodiments of the present invention are best understood by considering now the embodiments illustratively set forth in the drawings.

Figure 2:
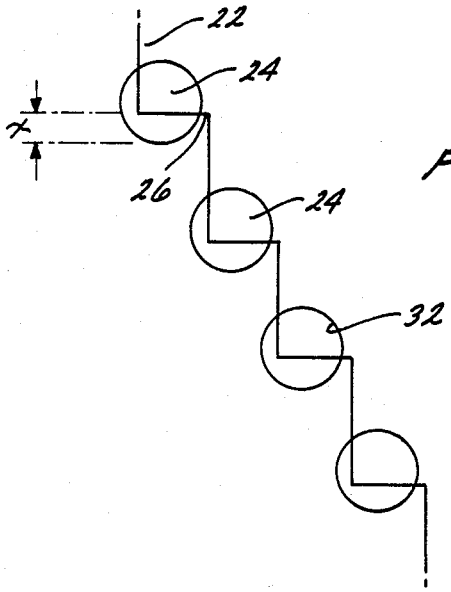
FIG. 2 is a diagrammatic sectional view taken through line 2—2 of FIG. 1.

Turning now to FIGS. 1–4, the first plurality of teeth characterized by a preferential cutting performance for a first type of material, namely softer rock formations, is diagrammatically illustrated in plan view in FIG. 1 and in sectional view in FIG. 2 which is taken through line 2—2 of FIG. 1. This first plurality of teeth 20 shown in FIG. 1 is illustrated as being disposed on a raised pad 22 on the bit face of the rotating bit (not shown). In the illustrated embodiment, teeth 20 include a synthetic polycrystalline diamond element 24 bonded to a metalic cylindrical base to form a compact structure 24 which is then raised to a molded socket (not depicted) defined in land 22 of the bit face. As better shown in FIG. 2, a portion of compact cutting element 24 extends beyond bit face 26 of pad 22. The distance of exposure of compact element 24 above surface 26 of pad 22 is designated in FIG. 2 as a distance "X". In cross section, as illustrated in FIG. 2, plurality 20 of composite cutting elements 24 are each exposed above the surface of their corresponding pad by a distance X while the pads form in cross section a descending staircase toward the nose of the rotating bit.

In addition, as better shown in FIG. 2 a portion of pad 22 may also extend above surface 26 to integrally form a trailing support 28 continuous with and substantially congruous with the exposed cross-sectional area of the exposed portion of composite cutting element 24. As diagrammatically depicted in FIG. 2, such trailing supports would generally assume a circular bulbous or bullet-shaped form, circular both in plan section as well as perpendicular cross section. Such trailing supports 28 are well known to the art in combination with composite diamond cutting elements 24 sold by General Electric Company under the trademark Stratapax. The cylindrically shaped slugs comprising the diamond and metal support are commercially available as a unit and are brazed by the bit maufacturer into specially molded sockets which include as integral extension thereof trailing support 28. Therefore, the diamond portion of composite 24 will form the leading face 30 of plurality of teeth 20 while the metallic cylindrical support forming the other half of compact element 24 is bonded by brazing two integral trailing supports 28 extending above surface 26 of pad 22, the remaining portion of compact element 24 being disposed in and bonded to a molded receiving surface defined by the bit manufacturer by conventional molding processes in the bit face as suggested in FIG. 2.

Figure 3:
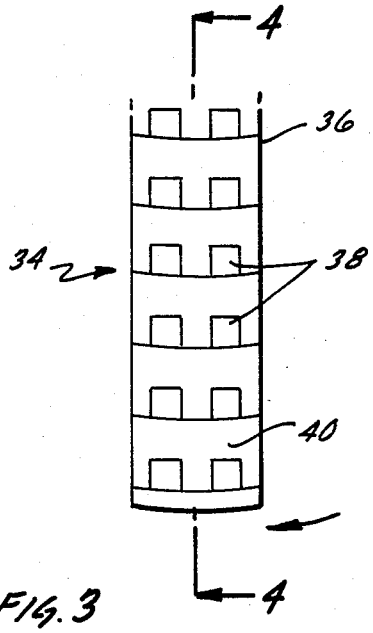
FIG. 3 is a diagrammatic plan view of teeth of a second type with a preferential cutting performance for a second type of material.
Figure 4:
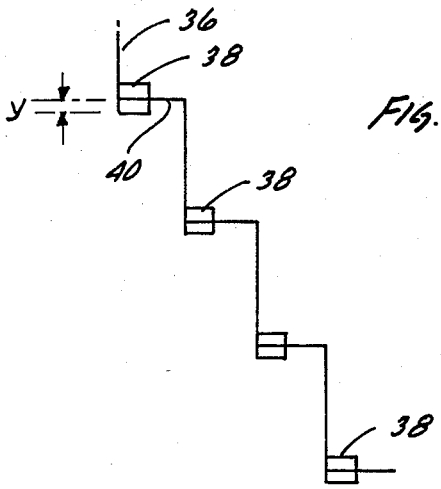
FIG. 4 is a diagrammatic sectional view taken through line 4—4 of FIG. 3.

FIGS. 3 and 4 depict a diagrammatic plan view of a second plurality of teeth characterized by a preferential cutting performance for a second type of material, such as harder rock formations. In the illustrated embodiments a second plurality of teeth 36 are shown in a double row in FIG. 3 including diamond cutting elements 38 within each tooth. In one embodiment of the present invention second plurality 34 of teeth may include natural diamonds such as round, cubic or carbonado diamonds or polycrystalline synthetic diamonds or sintered impregnated inserts, all of which are well known to the art for use as diamond cutting elements in rotating bits. Teeth 38 including such diamond materials generally include smaller cutting elements than used in the first plurality of teeth 20. For example, in the preferred embodiment where the first plurality of teeth 20 employ Stratapax compacts, the cylindrically shaped Stratapax have a diameter of approximately 13 millimeters. On the other hand, natural round diamonds used as cutting elements in the second plurality of teeth 34 have a diameter approximately in the range of 2 to 6 mm and in the case where polycrystalline synthetic diamonds are included in the second plurality of teeth 34, the largest overall dimension of diamond 38 is approximately 6 millimeters.

FIG. 4 taken through line 4—4 of FIG. 3 illustrates a diagrammatic sectional view of one of the rows of the second plurality of teeth 34. Diamond cutting elements 38 shown in FIG. 4 are characterized by an exposure above surface 40 of pad 36 of a distance denoted in FIG. 4 as "Y". The remaining portion of diamond cutting element 38 is either embedded within the bit face of the bit or included within a tooth design well known to the art or as devised by applicant and described in copending applications assigned to same assignee as the present Tooth Configuration for an Earth Boring Bit, Ser. No. 475,168, filed Mar. 14, 1983; Cutting Tooth and Rotating Bit Having Fully Exposed Polycrystalline Diamonds, Ser. No. 469,209 filed Feb. 24, 1983; Improved Tooth Design Using Cylindrical Diamond Cutting Elements, Ser. No. 477,048, filed Mar. 21, 1983; Improved Diamond Cutting element in a Rotary Bit, Ser. No. 374,020, filed Mar. 7, 1983; Cutter Configuration for a Gage-to-Shoulder Transition and Face Pattern, Ser. No. 394,611, filed May 20, 1983; and An Improved Diamond Rotating Bit, Ser. No. 470,507, filed Feb. 28, 1983.

The sectional view of FIG. 4 shows diamond cutting elements 38 forming a series of descending staircase-like steps in substantially the same manner as FIG. 2. Second plurality of teeth 34 and first plurality of teeth 20 as illustrated in FIGS. 1–4 are disposed on the same rotating bit. Pads 36 and 22 upon which the cutting elements are disposed are also substantially identical in their configuration and in their distance from the longitudinal axis of the rotating bit. In other words, second plurality of teeth 34 and first plurality of teeth 20 are placed on pads 36 and 22 respectively on the bit face of the rotating bit which lands are of substantially identical design. The particular design has been assumed in the illustrated embodiment of FIGS. 1–4 as a descending staircase on straight or longitudinal lands running from the nose of the bit to the gage to form a cone-like bit having a surface terraced by descending teeth. A cone bit incorporating the present invention having a similarly shaped profile is better illustrated in perspective view in FIG. 13.

Figure 13:
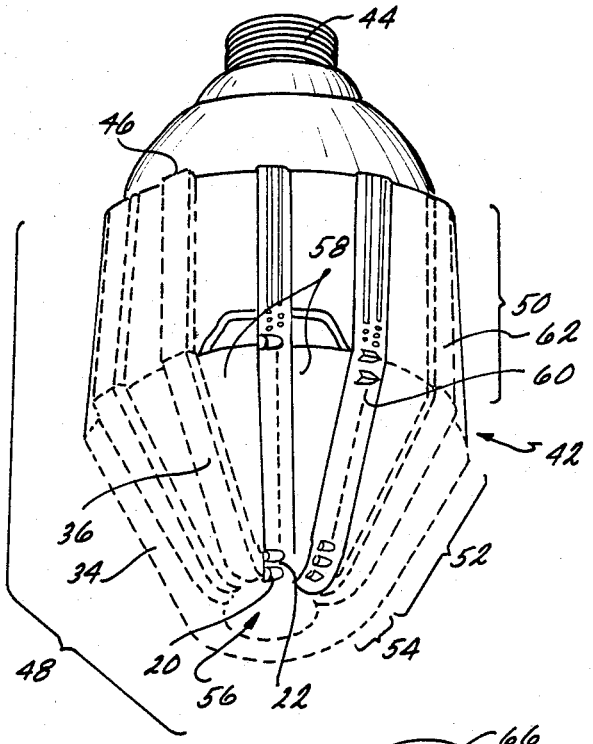
FIG. 13 is a perspective view of a coring bit incorporating the present invention.

Turning now to FIG. 13, a rotating bit, generally denoted by reference numeral 42 is illustrated in perspective view as including such conventional elements as a threaded shank 44 a steel body 46 and a furnaced bit face, generally denoted by reference numeral 48, bonded to body 46. Bit face 48 includes a gage portion 50, flank portion 52, nose 54, and apex 56. Pads 22 and 36 thus originate within apex 56 and extend over nose 54 and downwardly across flank 52 to gage 50. At gage 50 pads 22 and 36, which are separated by water courses 58, merge with broaches 60 defined in gage 50 into which a plurality of diamond cutting elements have been embedded or otherwise affixed in a conventional manner. Such gage diamond cutting elements are conventionally termed as kickers 62.

Return now to FIGS. 1–4 and in particular to the diagrammatic sectional views of pad 22 in FIG. 2 and of pad 36 in FIG. 4. In addition to the type of diamond cutting element used in compacts 24 or elements 38, compacts 24 and elements 38 are distinguished one from each other by the distance X and Y respectively by which the cutting element is exposed to extend above the surface of the corresponding pad in which the cutting element is disposed. In the first embodiment, as suggested by the diagrammatic scale of FIGS. 1–4 the distance X is greater than the distance Y. The larger compacts 24, which are ideally designed for obtaining a large bite for efficient cutting action in the softer rock formations, are thus exposed more than the natural diamonds, synthetic diamonds or sintered impregnated inserts used as cutting elements 38 of the second plurality of teeth 34. Therefore, a bit of the type shown in FIG. 13 with teeth as diagrammatically depicted in FIGS. 1–4 will engage the rock formation with the first plurality of teeth 20 because of the greater distance X by which compacts 24 are exposed. Thus, in softer rock formations compacts 24 will provide the main cutting action and cutting elements 38 will tend to be held away from the rock formation or at least held from full engagement with the rock formation.

However, when a stratified layer of a harder or more abrasive rock formation is encountered, compacts 24 will tend to wear away due to the inherent composition of the Stratapax compacts 24. The wear however, is limited by the exposure of the second plurality of teeth 34. In other words, first plurality of teeth 20 will wear away until second plurality of teeth 34 engage or fully engage the rock formation to be cut. When the second plurality of teeth 34 are engaged after the greater distance Y of first plurality of teeth 20 is worn down to equal the distance Y, the primary cutting action will then be taken up by the second plurality of teeth 34.

When a softer rock formation is again encountered in a stratified layer, the smaller size of the second plurality of teeth 34 will not prevent elements 38 from obtaining a large bite on the softer rock formation. Once again, the remaining unworn portions of compacts 24 of the first plurality of teeth 20 will provide the primary cutting action of the bit since the size and design of these teeth are maximally efficient in a softer formation.

When it is known that harder layers will be drilled first in a stratified formation, the distance X shown in FIG. 2 may be made smaller than the distance Y shown in FIG. 4. In that case, a first contact with the rock formation will be made by diamond cutting elements 38 included within second plurality of teeth 34. A first plurality of teeth 20 will be held out of contact from the rock formation and substantially all of the cutting action of the rotating bit will be performed by the second plurality of teeth 34. As stated, diamond cutting elements 38 of the second plurality of teeth 34 are particularly adapted for cutting hard and abrasive rock formations. The compacts 24 of the first plurality of teeth 20 will thus not be worn until the hard rock layer is penetrated and a softer rock layer encountered. When a softer rock formation is encountered, second plurality of teeth 34 will embed deeply into the rock formation thereby allowing the full engagement of the first plurality of teeth 20. The first plurality of teeth 20 will then be fully or nearly fully engaged with the softer rock formation thereby taking advantage of the more efficient cutting action provided by compacts 24 in such softer formations. However, when a harder layer of rock is again encountered, compacts 24 will be held from full engagement with the rock formation by the second plurality of teeth 34 which will fully engage, but will not be as deeply embedded into the rock formation being cut as is the case with a softer rock formation. Once again, compacts 24 will be spared from wearing action and the primary cutting action of the bit performed by second plurality of teeth 34. The preferential cutting action of the first and second pluralities of teeth 20 and 34 will continue as additional stratified layers are penetrated and as long as there is a sufficient difference in the exposure, X and Y, between the two types of cutting elements.

For example, in the illustrated embodiment, where Stratapax slugs are used for the first plurality of teeth 20 and polycrystalline synthetic diamonds, such as manufactured by General Electric Company under the trademark GEOSET 2102 or 2103 are used for the second plurality of teeth 34, and where it is determined, as in the first embodiment described in connection with FIGS. 1–4, namely that embodiment where the distance X as less than the distance Y, the distance X is chosen as 4 millimeters and the distance Y is approximately 5 millimeters.

In the second embodiment of FIGS. 5–8 the distance x is 4 mm and the Y distance is 5 mm.

Figure 14:
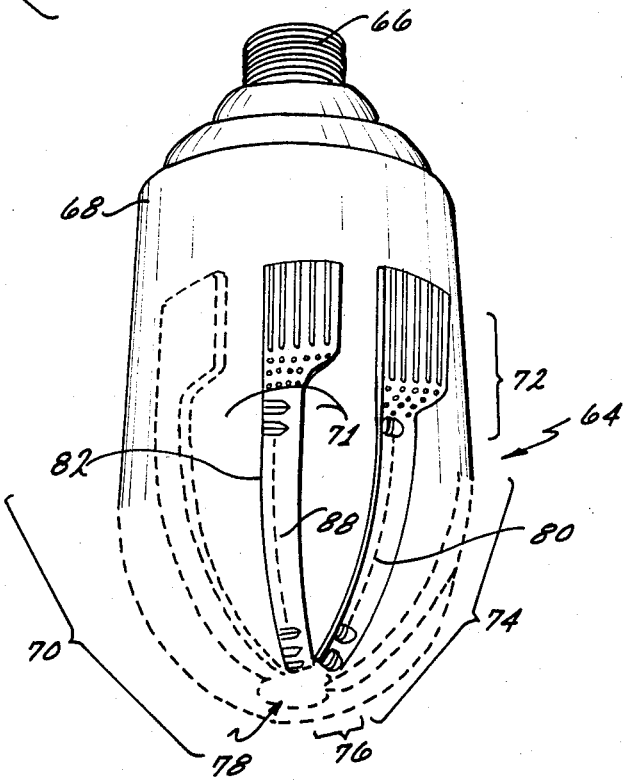
FIG. 14 is a perspective view of a petroleum bit incorporating the present invention.

The present invention may be used on any bit profile well known to the art in addition to the conical shapes as shown in FIG. 13. FIGS. 5–8 illustrate a second embodiment wherein the present invention is incorporated in a rotating bit having a rounded or curved profile. Turning now to FIG. 14, a perspective view of such a curved bit is illustrated. Again, the bit, generally denoted by reference numeral 64, includes a threaded shank 66, a body 68 bonded to a bit face generally denoted by reference numeral 70. Bit face 70 includes a gage 72, flank and shoulder 74, nose 76 and apex 78. A plurality of pads are provided across flank and shoulder 74, nose 76 and apex 78. In the illustrated embodiment, two types of pads are provided across bit face 70 in a longitudinal direction, namely a pad 80 and pad 82.

Turning now to FIGS. 5–8, pad 80 is diagrammatically illustrated in plan view in FIG. 5 and diagrammatically shown in sectional view in FIG. 6 taken through line 6—6 of FIG. 5. Similarly, pad 82 is shown in diagrammatic plan view in FIG. 7 with a cross-sectional view shown in FIG. 8 taken through line 8—8 of FIG. 7. As in the instance of the first embodiment described in connection with FIGS. 1–4, pad 80 as shown in FIGS. 5 and 6 include a composite slug or compact 84 brazed or otherwise bonded to a mating indentation molded in pad 80 on bit face 70. Compacts 84 are similarly supported by an intregal trailing portion 86 formed in substantially the same manner and shape as trailing support 28 described in connection with the embodiment of FIG. 1. Referring specifically to FIG. 6, compacts 84, the leading face of which is shown in FIG. 6, are characterized by an exposure or extent above surface 88 of pad 80 of a distance "X."

Similarly, pad 82 is provided with a second plurality of teeth, generally denoted by reference numeral 90 including diamond cutting elements 92. Again, the second plurality of teeth 90 may assume any specific teeth design well known to the art or as presently devised by assignee of the present invention. Thus, diamond cutting elements 92 are highly diagrammatically shown in FIGS. 7 and 8 and their graphic depiction should not be taken as a limitation of the tooth design or the manner in which the diamond cutting element 92 is attached to, embedded in, or disposed on surface 94 of pad 82.

Referring now to FIG. 8, cutting elements 92 are particularly characterized by an exposure of each element 92 above surface 94 of pad 82 by a distance "Y." As seen in cross section of FIGS. 6 and 8, the longitudinal shape of pads 80 and 82 are substantially identical and curvilinear. Therefore, as rotating bit 64 engages a rock formation, the first cutting element in contact with the rock formation will be that element having the greatest displacement from the surface of its corresponding pad. For example, in the case where distance X is greater than distance Y as shown in FIGS. 6 and 8, compact cutting elements 84 will first contact the rock formation thereby maintaining elements 92 out of contact with the rock formation. Cutting action will thus be primarily attributible to compacts 84. Again, compacts 84 are particularly adapted for efficient cutting and maximum bite in softer rock formations. However, when a harder layer is reached, compacts 84 will wear down until the distance X is substantially equal to distance Y. At this point cutting elements 92 will come in contact with the rock formation and ultimately fully engage the harder formation. Elements 92, which may be composed of various forms of natural diamond, synthetic polycrystalline diamond, or impregnated sintered diamond, will then provide the primary cutting action in the hard or abrasive rock. In other words, the wear of compacts 84 will be limited by engagement of the second plurality of teeth 90.

The embodiment of FIGS. 5–8 and 14 may also be designed such that the distance Y is greater than the distance X. Again, in this situation a first cutting elements to contact the rock formation will be the hard rock cutting elements 92. These elements will thus retain compact elements 84 out of contact with the rock formation. If the rock formation is a hard rock formation, primary cutting action will be provided by cutting elements 92 and compacts elements 84 will not engage the rock formation until a softer layer is encountered, thereby allowing full penetration of second plurality of teeth 90 and thence allowing engagement by first plurality of teeth 85.

Clearly, the second embodiment of FIGS. 5–8 and 14 operate in substantially the same manner as the first embodiment of FIGS. 1–4 and 13. The present invention can clearly be adapted to numerous types of bits and bit profiles, according to the present teachings.

FIGS. 9 and 10 illustrate a third embodiment of the present invention wherein a first type of cutting element 100 is disposed upon the same pad or slug as a second type of cutting element 102. As before, cutting element 100 is a composite including a polycrystalline diamond table 106 bonded to a metalic base or slug 104 which in turn is brazed to a molded indentation provided in bit face 108. As before a trailing support 110 is intregally formed from the matrix material of bit face 108 and is contiguous to and substantially congruous with the trailing surface 112 of compact 100. Trailing support 110 is however, lengthened to allow intregal disposition of a pad 114 on the upper surface of support 110. Pad 114 includes a plurality of diamond cutting elements 116, which as before may be various forms of natural diamond, synthetic polycrystalline diamond or sintered impregnated diamond. Compact 100 thus provides an element particularly adapted for cutting soft formations while plurality of smaller cutting elements 116 on pad 114 are particularly adapted for cutting harder, abrasive rock formations.

As better shown in FIG. 9, the distance by which composite element 100 is exposed, the distance X, is different than the distance Y by which diamond cutting element 116 is extended. In other words, the structure shown in FIG. 9 is disposed on bit face 18 such that the instantaneous direction of linear travel is shown by arrow 118. The outermost extremity of compact 100 extends to a predetermined distance away from the longitudinal axis of the rotating bit or to an imaginary plane 118 coincident with the surface of the bit face 108. On the other hand, diamond elements 116 are disposed in pad 114 in such a manner that they extend a distance Y from imaginary plane 118. The first element to contact the rock formation will be that element most distantly disposed. For example, in the case where Y is greater than the distance X as shown in the embodiment of FIGS. 9 and 10, diamond element 102 will first contact the rock formation thereby preventing any portion of compacts 100 from significantly contributing to the cutting performance. Therefore, if the rotating bit were drilling through a hard rock formation, primary cutting action would be provided by diamond elements 116 and wear would be minimized on compact 100. When a softer rock layer was encountered, the smaller diamond elements 116 included within the second plurality of teeth 102 would fully penetrate the softer rock formation thereby permitting engagement of compacts 100 which would then deeply bite into the formation and provide the primary cutting action. When a hard or abrasive layer was once again encountered the bit would "ride up" on second plurality of teeth 102, thereby minimizing the wear of compacts 100 by such a harder layer and maximizing the efficiency of the cutting action with the use of elements 116 which are particularly adapted for such harder formations.

The embodiment of FIGS. 11 and 12 illustrate the case where the distance Y is less than the distance X, namely that case where the first cutting element to engage the rock formation will be compact 100 and not diamond element 102. As diagrammatically best illustrated in FIG. 11, the distinction between this embodiment and that shown in connection with FIG. 9 is that the diamond cutting elements 102 are more deeply embedded within pad 114, and pad 114 is provided with a smaller profile or extension away from surface 120 of trailing support 110.

Thus, when it is known that a softer rock formation will be encountered first, the design of FIGS. 11 and 12 may be chosen. Compacts 100 first engage the rock formation providing a full deep penetration for maximal cutting efficiency. When a harder layer is reached, compacts 100 will wear away until the distance X is substantially equal to the distance Y, in other words until the second plurality of teeth 102 including diamond cutting elements 116 engage and penetrate the rock formation. At this point, elements 102 will provide the primary cutting action and limit further wear of compacts 100. Later when a softer layer is again encountered, the smaller second plurality of teeth 102 will fully penetrate the softer rock allowing the remaining, unworn portions of compacts 100 to engage the rock formation and once again take up the primary cutting action.

The third and fourth embodiments of FIGS. 9–10 and 11–12 respectively, have been shown in isolation any specific bit profile or configuration of pads. Thus, it must be expressly understood that both of these embodiments may be arranged on any pad design and bit profile well known to the art. For example, the pad layout and bit profiles illustrated in FIGS. 13 and 14 in connection with the first and second embodiments of FIGS. 1–4 and FIGS. 5–8 respectively could incorporate the invention as represented in the third and fourth embodiments with equal ease.

Many alternations and modifications may be made by those with ordinary skill in the art without departing from the spirit and scope of the present invention. For example, although polycrystalline compacts have been shown in each of the embodiments as the composition of diamond used as the first plurality of diamonds particularly adapted for cutting soft formations, it must be expressly understood that such elements may also be made from synthetic polycrystalline diamonds of the type previously described with the second plurality of teeth including natural diamonds or sintered impregnated diamonds. The type of diamond used in each of the plurality of teeth have been described in the preferred embodiments only for the purposes of illustration. It is not intended to limit or restrict the scope of the present invention with respect to the type of diamonds or other cutting elements which may be incorporated in the first or second plurality of teeth. The illustrated embodiment has been described only for the purposes of clarity and example, and should not be taken as a limitation or definition of the invention as set forth in the following claims.

I claim:

1. An improvement in a rotating bit having a bit face comprising:

a first plurality of cutting teeth of a first shape and composition positioned on said bit face, said cutting teeth of said first plurality adapted by said shape and composition to optimally cut a first type of material; and a second plurality of cutting teeth included on said bit face of a second shape and composition adapted by said shape and composition to optimally cut a second type of material, said first plurality of teeth positioned on said bit face to primarily cut said first type of material and secondarily cut said second type of material, said second plurality of teeth positioned on said bit face to primarily cut said second type of material and secondarily cut said first type of material, whereby cutting performance of said rotating bit with said first and second plurality of teeth is primarily attributable to said first or second plurality of teeth depending on whether said rotating bit is cutting said first or second type of material respectively.

2. The improvement of claim 1 wherein said first plurality of teeth include a diamond cutting element of a first type particularly adapted to cutting softer materials and wherein said second plurality of teeth include a diamond cutting element particularly adapted to cutting harder materials, wherein said first plurality of teeth extend above said bit face by a first predetermined distance and wherein said second plurality of teeth extend above said bit face by a second predetermined distance, said first and second predetermined distances characterized by different magnitudes.

3. The improvement of claim 2 wherein said first predetermined distance is less than said second predetermined distance, whereby when said rotating bit is in hard material cutting is attributable primarily to said second plurality of teeth extending beyond said bit face by a second predetermined distance greater than said first predetermined distance thereby holding said first plurality of teeth away from said material and thereby preventing cutting by said first plurality of teeth, and whereby when said rotating bit is in softer material said first and second plurality of teeth both penetrate into said material and cut said material.

4. The improvement of claim 3 wherein said first plurality of teeth collectively provides more cutting surface than said second plurality of teeth when said first and second plurality of teeth fully engages material to be cut, whereby cutting of softer material is primarily attributable to said first plurality of teeth.

5. The improvement of claim 2 wherein said first predetermined distance is greater in magnitude than said second predetermined distance whereby said first plurality of teeth first substantially engage softer material to be cut thereby providing the primary cutting action, and whereby said rotating bit when engaging harder material wears first plurality of teeth until said second plurality of teeth contact and engage said harder material to be cut.

6. The improvement of claim 1 wherein each of said first plurality of cutting teeth of said first shape and composition is disposed on said bit face and wherein each of said second plurality of teeth of said secone shape and composition is disposed on a corresponding one of said first plurality of cutting teeth.

7. The improvement of claim 6 wherein said first and second plurality of cutting teeth include a diamond cutting element within each tooth and wherein said diamond cutting element included within each of said second plurality of said teeth of said second type is disposed on one of said first plurality of teeth of said first type is the outermost engaging portion of said first and second plurality of teeth, and thereby first engages material to be cut.

8. The improvement of claim 6 wherein said first and second plurality of cutting teeth include a diamond cutting element within each tooth and wherein said diamond cutting element included within said first plurality of said teeth of said first type is the outermost engaging portion of said first and second plurality of teeth and thereby first engage material to be cut.

9. The improvement of claim 6 wherein each of said first plurality of teeth is a compact diamond cutting element particularly adapted for cutting soft and medium-hard rock formations and wherein each of said second plurality of teeth is particularly adapted for cutting abrasive and harder rock formations.

10. The improvement of claim 9 wherein said compacts forming said first plurality of teeth are disposed on said bit face to provide a diamond cutting element as a leading face of said first plurality of teeth, each tooth of said first plurality of teeth characterized by an upper surface, said second plurality of teeth disposed on said upper surface.

11. The improvement of claim 10 wherein said second plurality of teeth are disposed on said upper surface of said first plurality of teeth by disposition in a pad disposed on said upper surface.

12. The improvement of claim 11 wherein said second plurality of teeth are disposed in said pad on said upper surface so that said diamond cutting elements incorporated in said second plurality of teeth are disposed at a greater distance from said bit face than said diamond cutting elements included in said first plurality of teeth.

13. The improvement of claim 11 wherein said second plurality of teeth are disposed in said pad on said upper surface so that said diamond cutting elements incorporated in said first plurality of teeth are disposed at a greater distance from said bit face than said diamond cutting elements included in said second plurality of teeth.

14. The improvement of claim 1 wherein at least one of said second plurality of cutting teeth corresponds to one of said first plurality of cutting teeth, said corresponding one of said second plurality of cutting teeth disposed on said one of said first plurality of cutting teeth to position said second plurality of teeth to primarily cut said second type of material, whereby at least one of said second plurality of teeth rides piggy-back on one of said first plurality of teeth.

15. The improvement of claim 14 wherein said corresponding one of said second plurality of cutting teeth is disposed on a generally longitudinal surface of said one of said first plurality of cutting teeth.

16. The improvement of claim 15 wherein angular orientation of said one of said first plurality of cutting teeth on said bit face is such that said corresponding one of said second plurality of cutting teeth is longitudinally disposed below the lowermost longitudinal portion of said one of said first plurality of cutting teeth.

17. The improvement of claim 15 wherein angular orientation of said one of said first plurality of cutting teeth on said bit face is such that said corresponding one of said second plurality of cutting teeth is longitudinally disposed above the lowermost longitudinal portion of said one of said first plurality of cutting teeth.

18. An improvement in a rotating bit having a bit face comprising:

a first plurality of cutting teeth of compact diamond cutters disposed on said bit face, said cutting teeth adapted to optimally cut soft and medium-hard rock formations; and a second plurality of cutting teeth of surface-set diamond cutters disposed on said bit and adapted to optimally cut hard and abrasive rock formations, wherein said first and second plurality of cutting teeth are disposed on said bit to selectively cut said soft, medium-hard rock formations or said hard and abrasive rock formations, said selective cutting performance as between sadi first and second plurality of cutting teeth effected by relative displacement of said first and second plurality of teeth with respect to said bit face, whereby a selected bype of said first and second plurality of teeth engage said rock formation.

19. The improvement of claim 18 wherein each said compact cutter comprising one of said first plurality of teeth is set below said surface-set diamond cutter comprising one of said second plurality of teeth so that said surface-set diamond cutter first engages said rock formation, whereby said surface-set diamond cutter provides primary cutting action should said rock formation be a hard or abrasive rock formation and whereby said surface-set diamond cutter deeply embeds into said rock formation should said rock formation be a soft to medium-hard rock formation.

20. The improvement of claim 18 wherein each said surface-set diamond cutter is set below a corresponding said compact diamond cutter whereby said compact diamond cutters first engage said rock formation.

21. The improvement of claim 18 wherein each said surface-set diamond cutter is disposed on a corresponding said compact diamond cutter, said compact diamond cutters being inclined with respect to said bit face wherein said surface-set diamond cutters are selectively disposed on said compact diamond cutters to be either selectively disposed above or below said compact diamond cutters depending upon the degree of disposition of said surface-set diamond cutters above or below the outermost portion of said compact diamond cutter.

22. The improvement of claim 18 wherein said first and second plurality of teeth are disposed on said bit face in a corresonding plurality of pads wherein each pad has disposed thereon teeth of only one type.

23. The improvement of claim 18 wherein said first and second plurality of teeth are disposed on a plurality of pads on said bit face and wherein each said pad includes both types of said teeth.

* * * * *